US007234478B2

(12) United States Patent
Kanzaki et al.

(10) Patent No.: US 7,234,478 B2
(45) Date of Patent: Jun. 26, 2007

(54) HIGH FREQUENCY HEATING APPARATUS

(75) Inventors: Kouji Kanzaki, Yamatokoriyama (JP); Yuji Hayakawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 372 days.

(21) Appl. No.: 10/634,160

(22) Filed: Aug. 5, 2003

(65) Prior Publication Data

US 2004/0025910 A1 Feb. 12, 2004

(30) Foreign Application Priority Data

Aug. 6, 2002 (JP) ..... P. 2002-228948

(51) Int. Cl.
*B08B 3/10* (2006.01)

(52) U.S. Cl. ..... 134/105; 134/115 R; 134/166 R; 134/169 R

(58) Field of Classification Search ..... 134/105, 134/166 R, 169 R, 115 R
See application file for complete search history.

(56) References Cited

U.S. PATENT DOCUMENTS

| | | | | |
|---|---|---|---|---|
| 6,008,482 | A * | 12/1999 | Takahashi et al. | 219/687 |
| 6,040,564 | A * | 3/2000 | Ueda et al. | 219/682 |
| 6,218,650 | B1 * | 4/2001 | Tsukamoto et al. | 219/681 |
| 6,478,034 | B1 | 11/2002 | Durth et al. | |

FOREIGN PATENT DOCUMENTS

| | | | |
|---|---|---|---|
| JP | 1-305227 | * | 12/1989 |
| JP | 3-58223 | | 6/1991 |
| JP | 08-178298 | | 7/1996 |
| JP | 10-078224 | | 3/1998 |
| JP | 10-292919 | * | 11/1998 |
| JP | 11-351620 | | 12/1999 |
| JP | 2000-082580 | | 3/2000 |
| JP | 2001-254952 | * | 1/2001 |
| JP | 2001-355843 | * | 1/2001 |
| JP | 2001-355843 | | 12/2001 |
| JP | 2002-523723 | | 7/2002 |

OTHER PUBLICATIONS

WIPO WO 97/01065 Jan. 1997.*
WIPO WO 99/33347 Jul. 1999.*
European Patent Office 334 772 Aug. 1989□□□□European Patent Office 598 211 Nov. 1992.*
European Patent Office 1 395 090 Jan. 2003.*

* cited by examiner

*Primary Examiner*—Frankie L. Stinson
(74) *Attorney, Agent, or Firm*—Pearne & Gordon LLP

(57) ABSTRACT

Cleaning according to an evaporating dish cleaning mode or heating chamber cleaning mode is implemented based on a signal inputted by the control part. In the heating chamber cleaning mode, condensation is generated on the inner surface of the heating chamber 11 by steam, and the soil adhered to the inner surface of the heating chamber 11 is allowed to float to be in a state of removing it easily. In the evaporating dish cleaning mode, a cleaning liquid made of citric acid solution is pumped into an evaporating dish 35, it is heated to a predetermined temperature, and it is left therein. Therefore, calcium and magnesium deposited on the evaporating dish 35 are allowed in a state of removing them easily.

10 Claims, 9 Drawing Sheets

HIGH FREQUENCY HEATING APPARATUS

BACKGROUND OF THE INVENTION

The present invention relates to a high frequency heating apparatus in which an object to be heated is heat-treated with the combination of high frequency and steam, and the inside of a heating chamber soiled by the heat treatment is cleaned.

In a high frequency heating apparatus for heat-treating an object to be heated by high frequency, there are a single function type of performing only high frequency heating and a multi-function type added with an oven function. However, in these pieces of the high frequency heating apparatus, juice or leavings of the object to be heated are sometimes adhered to the inside of a heating chamber for accommodating and heat-treating the object to be heated during heat treatment. When they are left as they are, adherents and burnt deposits are generated to soil the inside of the heating chamber. Such adhered soil causes not only a problem in keeping the inside of the heating chamber hygienic but also a factor that generates smoke in high frequency heating. On this account, the soil inside the heating chamber is removed by cleaning the inside of the heating chamber frequently or by a high temperature burning function provided in the heating apparatus itself.

However, cleaning the inside of the heating chamber is bothersome work, and the adhered soil is hard to be cleaned. A neutral detergent is sometimes used when soil is severe. In this case, a sufficient wipe is needed to cause the cleaning work to be harder. In addition, when cleaning is performed by the high temperature burning function, it is often difficult to remove the adhered soil completely even though a part of the soil is decomposed to remove odors, which inevitably depends on manual work in the end.

In the meantime, a cleaning method of obtaining excellent washability is known that a container with water is placed in a heating chamber for high frequency heating, steam is filled inside the heating chamber to loosen the soil adhered to the inside of the heating chamber by the steam, and then the chamber is cleaned. However, when the inside of the heating chamber of the high frequency heating apparatus is cleaned by this cleaning method, effort is needed to put water in a heatproof container and to place it in the heating chamber every time when cleaning, and the heating apparatus has to be monitored until steam is filled, which is not usable.

Furthermore, some pieces of high frequency heating apparatus with steam generation function for supplying steam to the heating chamber are proposed. However, all of the heating apparatus generate steam used for heating the object to be heated, not for cleaning the heating chamber. Therefore, there is no high frequency heating apparatus with steam generation function having an automatic cleaning function programmed for cleaning the heating chamber. In other words, the usability in cleaning is not excellent.

Moreover, in a steam generating part of the high frequency heating apparatus with steam generation function, calcium and magnesium in moisture are concentrated in the process of generating steam, and are precipitated and fixed to the bottom of a vaporizing part or the inside of a pipe for water supply. Then, an amount of steam generated is reduced. Consequently, a problem is arisen to cause a dirty environment where mold is easily propagated. Particularly, in the configuration in which the vaporizing part for generating steam is embedded in the inaccessible portion under the heating chamber, in addition to the problem, there is a problem that it is hard to do the work to clean the periphery of the heating chamber.

SUMMARY OF THE INVENTION

The invention has been made in view of the circumstances. An object is to provide a high frequency heating apparatus in which steam used for heating an object to be heated is used for cleaning the inside of a heating chamber and this cleaning work can be done easily.

In order to achieve the object, a high frequency heating apparatus according to first aspect of the invention includes a high frequency generating part for supplying a high frequency into a heating chamber for accommodating an object to be heated and a steam generating part for supplying steam into the heating chamber in which the high frequency generating part and the steam generating part supply at least any one of the high frequency and steam into the heating chamber to heat-treat the object to be heated, the high frequency heating apparatus including: a control part having a heating chamber cleaning mode for automatically supplying steam into the heating chamber by the steam generating part to clean soil inside the heating chamber; and a signal input unit for allowing the control part to implement the heating chamber cleaning mode.

According to the high frequency heating apparatus, when the signal to implement the heating chamber cleaning mode is inputted, the control part allows steam to be automatically supplied into the heating chamber and to clean the soil inside the heating chamber. Therefore, the inside of the heating chamber adhered with soil can be cleaned significantly easily to be in a clean state with no complex work.

A high frequency heating apparatus according to the second aspect of the invention includes a high frequency generating part for supplying a high frequency into a heating chamber for accommodating an object to be heated and a steam generating part having an evaporating dish disposed inside the heating chamber for storing water and an evaporating dish heating unit for heating the evaporating dish to generate steam, the steam generating part for supplying steam into the heating chamber, in which the high frequency generating part and the steam generating part supply at least any one of the high frequency and steam into the heating chamber to heat-treat the object to be heated, the high frequency heating apparatus including: a control part having an evaporating dish cleaning mode for pumping a cleaning liquid into the evaporating dish and heating it by the evaporating dish heating unit to clean soil on the evaporating dish; and a signal input unit for allowing the control part to implement the heating chamber cleaning mode.

According to the high frequency heating apparatus, when the signal to implement the evaporating dish cleaning mode is inputted, the control part allows the evaporating dish heating unit to heat the cleaning liquid supplied into the evaporating dish and to clean the soil on the evaporating dish. Therefore, the evaporating dish adhered with soil can be cleaned significantly easily to be in a clean state with no complex work.

A high frequency heating apparatus according to third aspect of the invention includes a high frequency generating part for supplying a high frequency into a heating chamber for accommodating an object to be heated and a steam generating part having an evaporating dish disposed inside the heating chamber for storing water and an evaporating dish heating unit for heating the evaporating dish to generate steam, the steam generating part for supplying steam into the heating chamber, in which the high frequency generating part and the steam generating part supply at least any one of the high frequency and steam into the heating chamber to heat-treat the object to be heated, the high frequency heating apparatus including: a control part having a heating chamber cleaning mode for automatically supplying steam into the heating chamber by the steam generating part to clean soil inside the heating chamber, and an evaporating dish cleaning mode for pumping a cleaning liquid into the evaporating dish and heating it by the evaporating dish heating unit to clean soil on the evaporating dish; and a signal input unit for allowing the control part to implement any one of the cleaning modes.

According to the high frequency heating apparatus, when the signal to implement the heating chamber cleaning mode is inputted, the control part allows steam to be automatically supplied into the heating chamber and to clean the soil inside the heating chamber. When the signal to implement the evaporating dish cleaning mode is inputted, the control part allows the evaporating dish heating unit to heat the cleaning liquid supplied into the evaporating dish and to clean the soil on the evaporating dish. Therefore, the inside of the heating chamber and the evaporating dish adhered with soil can be cleaned selectively and significantly easily to be in a clean state with no complex work.

Preferably, in a high frequency heating apparatus, the heating chamber cleaning mode is a mode that water supplied into the evaporating dish of the steam generating part is heated by the evaporating dish heating unit and steam is filled inside the heating chamber to generate condensation on a surface defining the heating chamber for cleaning.

According to the high frequency heating apparatus, condensation is generated on the inner surface of the heating chamber by steam. Thus, the soil adhered to the inner surface of the heating chamber is allowed to float, and the inner surface of the heating chamber can be cleaned significantly easily to be in a clean state.

Preferably, a high frequency heating apparatus includes a circulation fan for stirring air inside the heating chamber, wherein when steam is generated by the steam generating part, and the generated steam is stirred inside the heating chamber.

According to the high frequency heating apparatus, the generated steam is stirred when steam is generated by the steam generating part. Thus, condensation is uniformly generated on the surface inside the heating chamber with steam balanced in the heating chamber, and the adhered soil can be removed further surely throughout the inside of the heating chamber.

Preferably, a high frequency heating apparatus includes a water supply part for supplying water to the evaporating dish.

According to the high frequency heating apparatus, water is supplied into the evaporating dish from the water supply part, and the water supplied into the evaporating dish is heated. Therefore, condensation is generated on the inner surface of the heating chamber to intend to facilitate cleaning.

Preferably, in a high frequency heating apparatus, the water supply part has a water tank, and a pump for supplying a predetermined amount of water into the evaporating dish from the water tank through a water pipe.

According to the high frequency heating apparatus, water in the water tank is supplied into the evaporating dish by the pump through the water pipe, thereby allowing a predetermined amount of water to be easily supplied into the evaporating dish.

Preferably, in a high frequency heating apparatus, the evaporating dish cleaning mode is a mode that water supplied into the evaporating dish of the steam generating part and the cleaning liquid are heated to a predetermined temperature by the evaporating dish heating unit and then they are left therein as they are for a predetermined time for cleaning.

According to the high frequency heating apparatus, water and the cleaning liquid are contained in the evaporating dish, they are heated to a predetermined temperature, and they are left standing therein, thereby allowing calcium and magnesium deposited on the evaporating dish to be removed surely and easily.

Preferably, in a high frequency heating apparatus, a citric acid solution is used as the cleaning liquid.

According to the high frequency heating apparatus, the citric acid solution dissolved with citric acid is used as the cleaning liquid, and the citric acid solution is heated to a predetermined temperature and left standing as it is in the evaporating dish, thereby allowing the deposit on the surface of the evaporating dish to be removed safely in food hygiene.

DETAILED DESCRIPTION OF THE PREFERRED EMBODIMENTS

Hereafter, a preferred embodiment of a high frequency heating apparatus in the invention will be described in detail with reference to the drawings.

Figure 1:
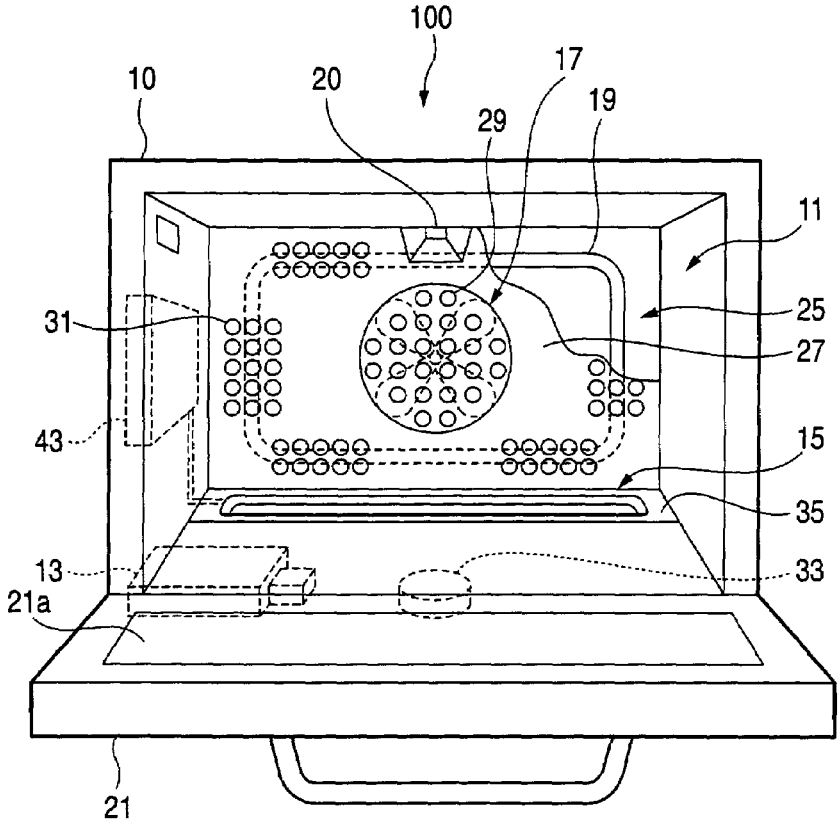
FIG. 1 is a front view illustrating a high frequency heating apparatus in the invention in which its door is opened.
Figure 2:
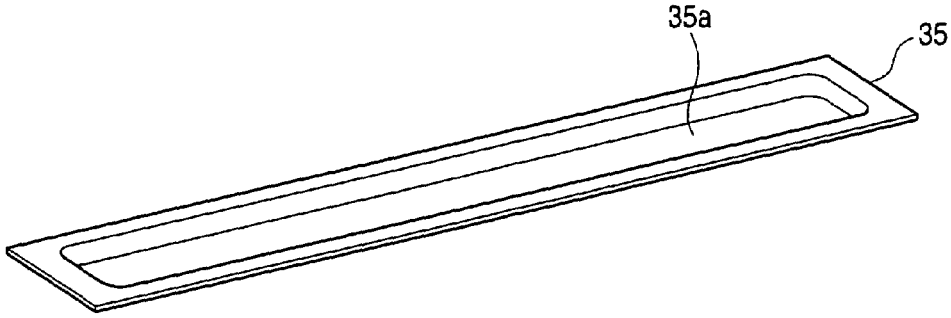
FIG. 2 is a perspective view illustrating an evaporating dish of a steam generating part for use in the high frequency heating apparatus shown in FIG. 1.
Figure 3:
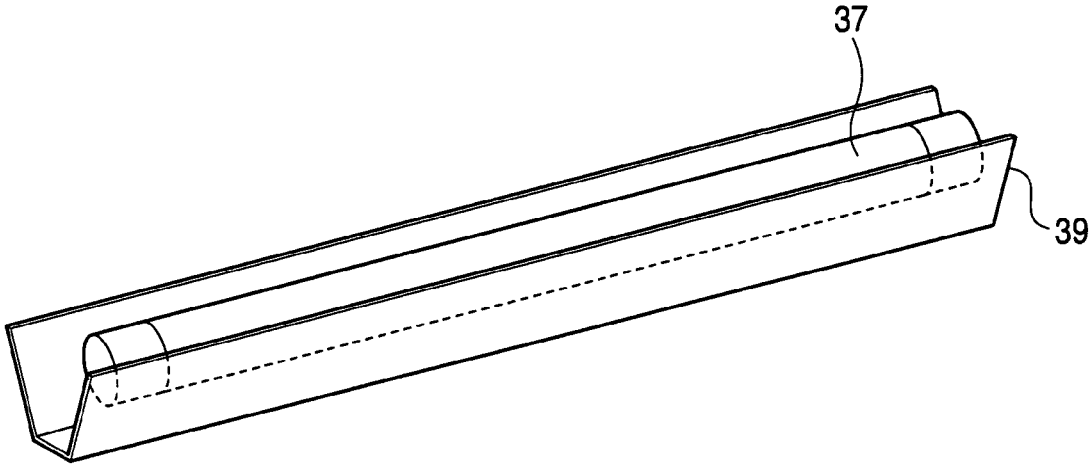
FIG. 3 is a perspective view illustrating an evaporating dish heater and a reflector of the steam generating part.
Figure 4:
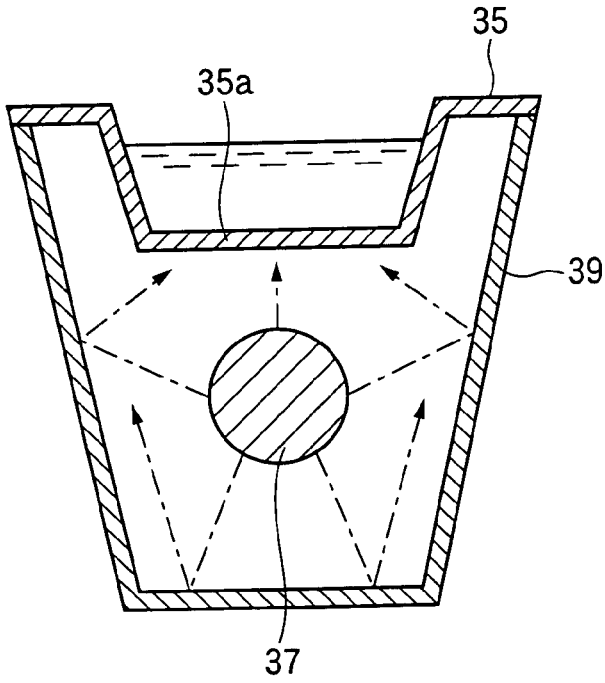
FIG. 4 is a cross sectional view illustrating the steam generating part.

FIG. 1 is a front view illustrating a high frequency heating apparatus in the invention in which its door is opened. FIG. 2 is a perspective view illustrating an evaporating dish of a steam generating part for use in the apparatus. FIG. 3 is a perspective view illustrating an evaporating dish heater and a reflector of the steam generating part. FIG. 4 is a cross sectional view illustrating the steam generating part.

First, the basic configuration of a high frequency heating apparatus 100 in the invention will be described.

This high frequency heating apparatus with steam generation function 100 is a cooking appliance in which at least any one of a high frequency (microwave) and steam is supplied into a heating chamber 11 for accommodating an object to be heated and the object to be heated is heat-treated. The apparatus has a magnetron 13 as a high frequency generating part for generating a high frequency, a steam generating part 15 for generating steam inside the heating chamber 11, a circulation fan 17 for stirring and circulating air inside the heating chamber 11, a convection heater 19 as a heater for heating air to circulate inside the heating chamber 11, an infrared sensor 20 for detecting temperature inside the heating chamber 11 through a detection hole disposed on the wall surface of the heating chamber 11, and a water tank 43 for supplying water to the steam generating part 15.

The heating chamber 11 is formed inside a box-shaped high frequency heating apparatus main case 10 with the front opened, and a door 21 with a translucent window 21*a* for opening and closing a drawing port for the object to be heated inside the heating chamber 11 is disposed in front of the high frequency heating apparatus main case 10. The door 21 is openable and closable by joining the lower end to the lower rim of the high frequency heating apparatus main case 10 by hinge. A predetermined heat insulation space is kept between the wall surfaces of the heating chamber 11 and the high frequency heating apparatus main case 10, and a heat insulator is filled in the space as required. A space behind the heating chamber 11 is a circulation fan chamber 25 for housing the circulation fan 17 and its drive motor (see FIG. 9) therein, and a rear wall of the heating chamber 11 is a partition plate 27 for defining the heating chamber 11 from the circulation fan chamber 25. The partition plate 27 is disposed with air intake vent holes 29 for taking in air from the heating chamber 11 side to the circulation fan chamber 25 side, and air blowing vent holes 31 for blowing air from the circulation fan chamber 25 side to the heating chamber 11 side. Each of the vent holes 29 and 31 is formed as a plurality of punched holes.

The circulation fan 17 is disposed so that the center part of the rectangular partition plate 27 is set to be the rotation canter, and the rectangular ring-shaped convection heater 19 is disposed inside the circulation fan chamber 25 as it surrounds the circulation fan 17. Then, the air intake vent holes 29 formed in the partition plate 27 are arranged in front of the circulation fan 17, and the air blowing vent holes 31 are arranged along the rectangular ring-shaped convection heater 19. When the circulation fan 17 is rotated, winds are set to flow from the front side of the circulation fan 17 to the rear side where the drive motor is disposed. Thus, air inside the heating chamber 11 is taken in the center part of the circulation fan 17 through the air intake vent holes 29, and it is sent from the air blowing vent holes 31 into the heating chamber 11 through the convection heater 19 inside the circulation fan chamber 25. Therefore, the air inside the heating chamber 11 is circulated by this flow through the circulation fan chamber 25 as the air is stirred.

The magnetron 13 is disposed in the space under the heating chamber 11, for example, and a stirrer 33 is disposed at the position receiving a high frequency generated from the magnetron. Then, by rotating the stirrer 33, the high frequency having been irradiated onto the stirrer 33 from the magnetron 13 is supplied into the heating chamber 11 as it is stirred. In addition, the magnetron 13 and the stirrer 33 can be disposed not only on the bottom of the heating chamber 11 but also on the top or side of the heating chamber 11. Furthermore, as a system of high frequency heating, a turning table system is acceptable.

The steam generating part 15 is configured of an evaporating dish 35 having a recess 35*a* for containing water to generate steam by heating as shown in FIG. 2, an evaporating dish heater 37 disposed under the evaporating dish 35 for heating the evaporating dish 35 as shown in FIGS. 3 and 4, and a reflector 39 having a nearly U-shape in cross section for reflecting radiant heat from the heater toward the evaporating dish 35. The evaporating dish 35 is a long slender plate made of stainless steel, for example, which is disposed so that its longitudinal side is oriented along the partition plate 27 in the rear bottom surface on the opposite side of the drawing port for the object to be heated inside the heating chamber 11, and is substantially disposed outside the detection range of temperature detection scanning by the infrared sensor 20. Moreover, as the evaporating dish heater 37, a glass tube heater, a sheathed heater, and a plate-heater are usable.

Figure 5:
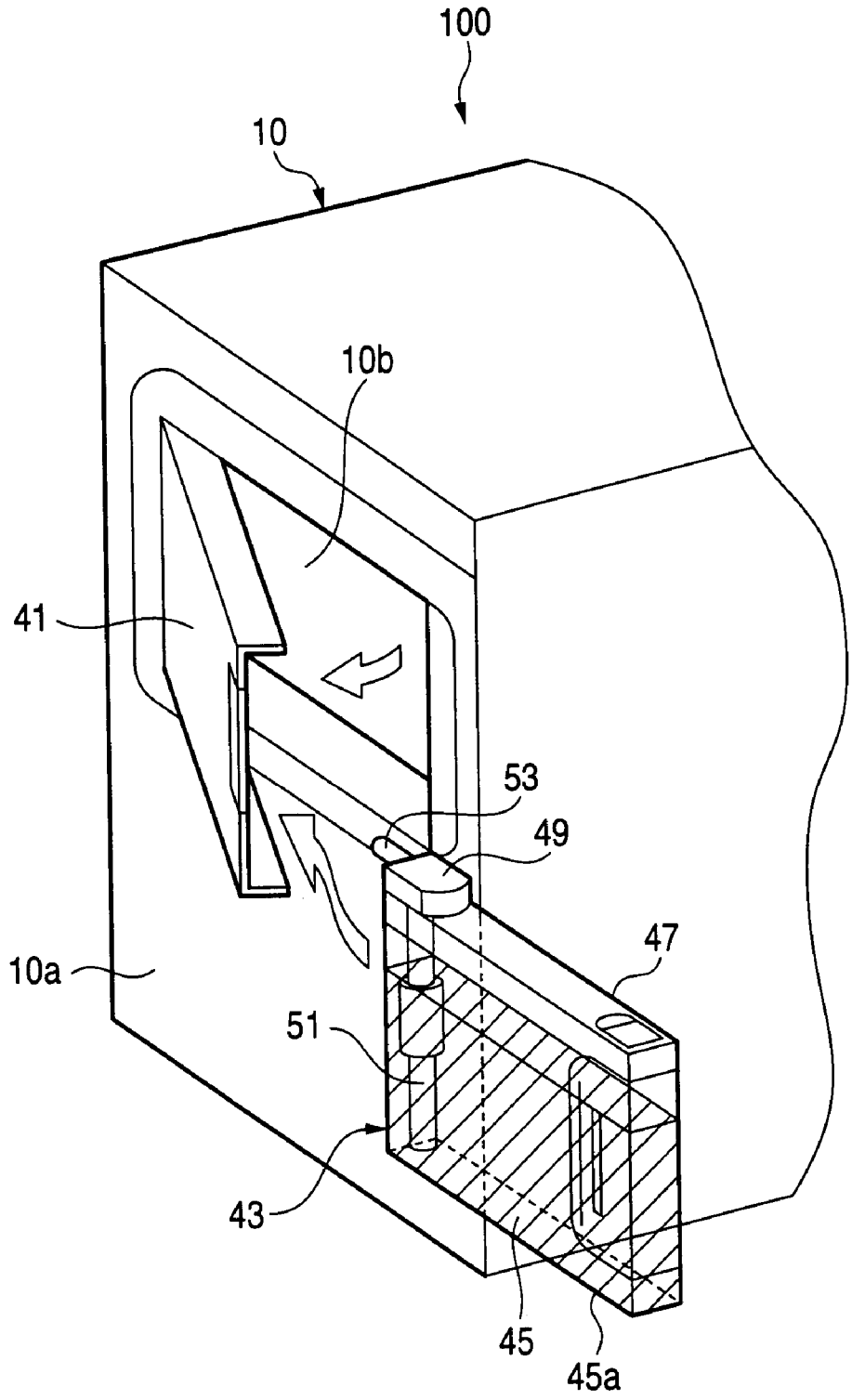
FIG. 5 is an explanatory diagram illustrating the manner that a water tank is housed in the side surface of the high frequency heating apparatus.
Figure 6:
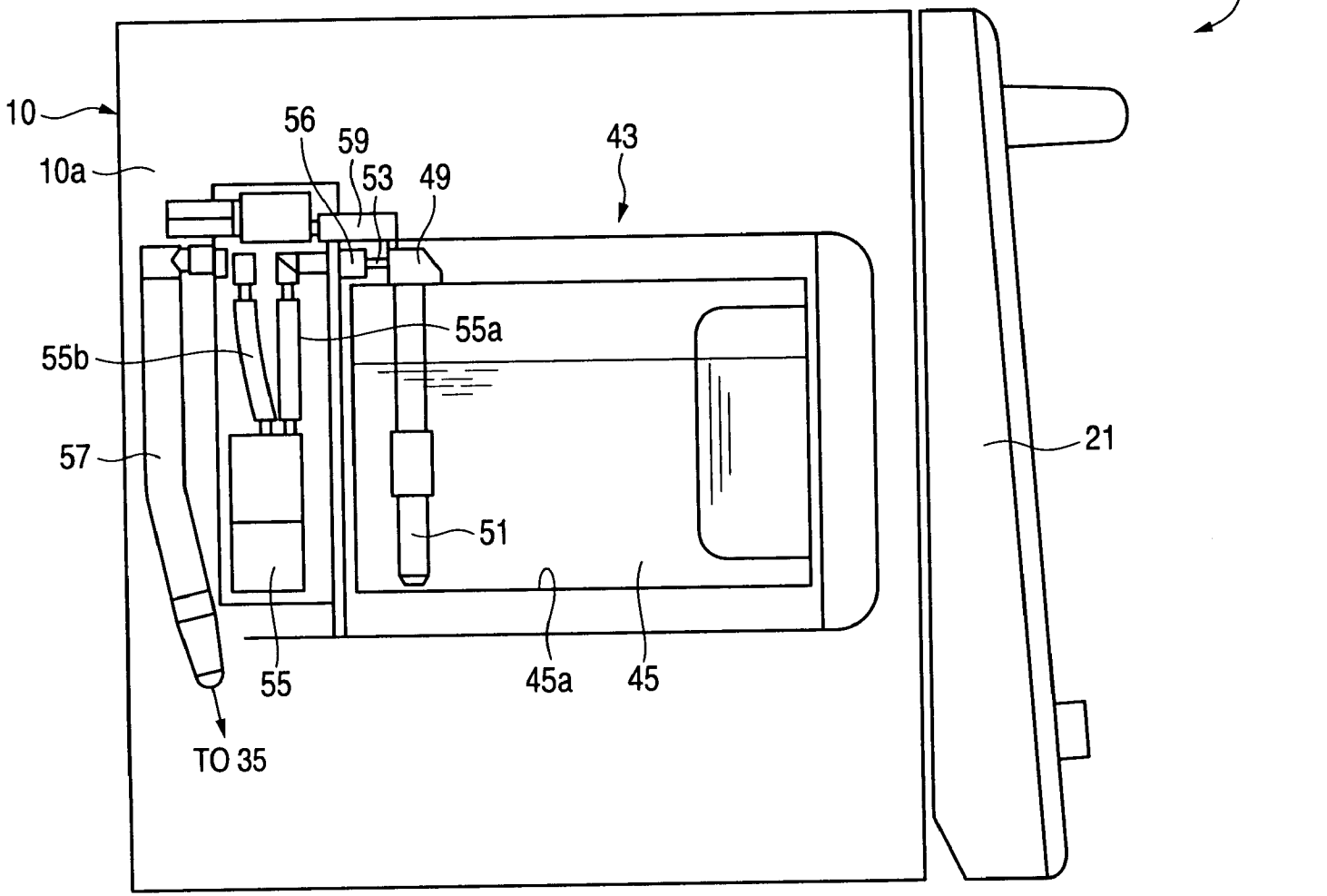
FIG. 6 is a side view illustrating the high frequency heating apparatus.

Here, FIG. 5 depicts an explanatory diagram illustrating the manner that the water tank is housed in the side surface of the high frequency heating apparatus, and FIG. 6 depicts a side view illustrating the high frequency heating apparatus. As shown in FIG. 5, a water tank cover 41 is disposed on a side wall 10*a* of the high frequency heating apparatus main body 10 as openable and closable, and the water tank 43 for supplying water to the steam generating part 15 is detachably housed in an internal space 10*b* of the side wall 10*a*. Referring with FIG. 6, the water tank 43 has a thin, rectangular main body 45 with the top opened, and a cover 47 detachably disposed in an opening of the main body 45. An intake pipe mounting part 49 is disposed on the cover 47, and an intake pipe 51 extending near a bottom 45*a* of the main body 45 as penetrating through the cover 47 is disposed under the intake pipe mounting part 49. In addition, a connecting pipe 53 is protruded in the back of the intake pipe mounting part 49 (the tip direction of inserting the water tank in FIG. 5).

Furthermore, as shown in FIG. 6, a pump 55 for intermittently discharging a fixed amount of water is disposed in the internal space 10*b* of the side wall 10*a* of the high frequency heating apparatus main body 10, and an intake pipe 55*a* and a feed pipe 55*b* are connected to the pump 55. The tip end on the opposite side of the pump 55 of the intake pipe 55*a* is coupled to a joint part 56 to which the end part of the connecting pipe 53 of the water tank 43 is detachably connected when the water tank 43 is housed inside the high frequency heating apparatus main body 10. In the meantime, the feed pipe 55*b* is connected to the evaporating dish 35 of the steam generating part 15 through a pipe 57. At the position above the intake pipe mounting part 49 of the water tank 43 in the internal space 10*b* of the side wall 10*a*, a water tank detachment detecting part 59 for detecting detachment of the water tank 43 is disposed, which detects whether to house the water tank 43.

Figure 7:
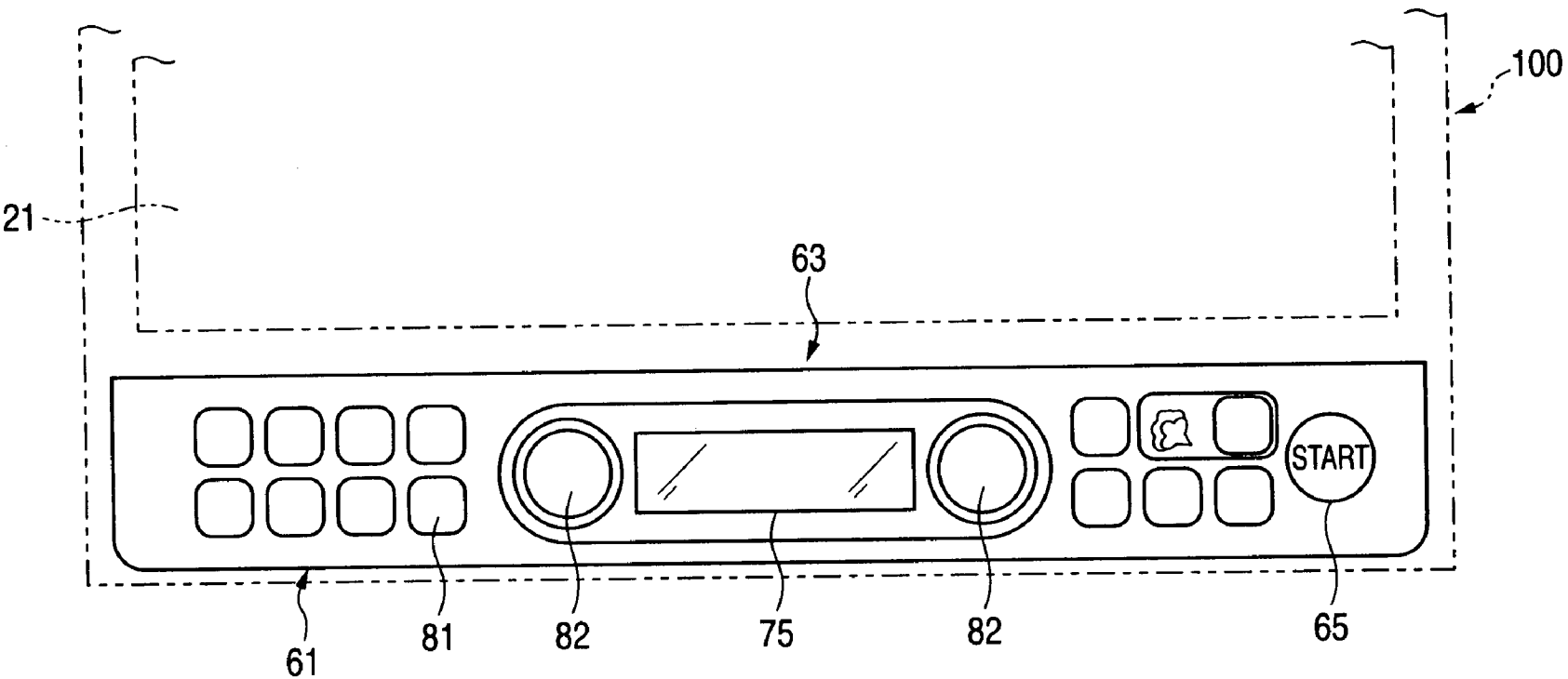
FIG. 7 is a front view illustrating the door where an input operation part and a display part of the high frequency heating apparatus are disposed.

As shown in FIG. 7 that depicts a part of the door of the high frequency heating apparatus 100, an input operation part 61 and a display part 63 are disposed under the door 21 on the front side of the high frequency heating apparatus 100. In the input operation part 61, a start switch 65 for instructing the start to cook, a cleaning switch 81 for cleaning, and setting dials 82 (signal input units) are disposed. Additionally, a display panel 75 is disposed in the display part 63 as an announcement unit. Furthermore, not shown in the drawing, it is acceptable to provide a function of sounding voice or warning sound.

The cleaning switch 81 can perform the cleaning operation of various modes by pressing down the switch. Moreover, the setting dials 82 are disposed on both sides of the display panel 75. Various settings can be selected by turning the setting dials 82.

Here, as the cleaning modes, there are an evaporating dish cleaning mode, a heating chamber cleaning mode, and a deodorizing mode. These various cleaning modes can be selected freely by pressing down the cleaning switch 81 and then turning the setting dials 82. Then, a mode is selected by the setting dials 82 and then the start switch 65 is pressed down, thereby implementing the selected cleaning mode by the high frequency heating apparatus 100.

Figure 8:
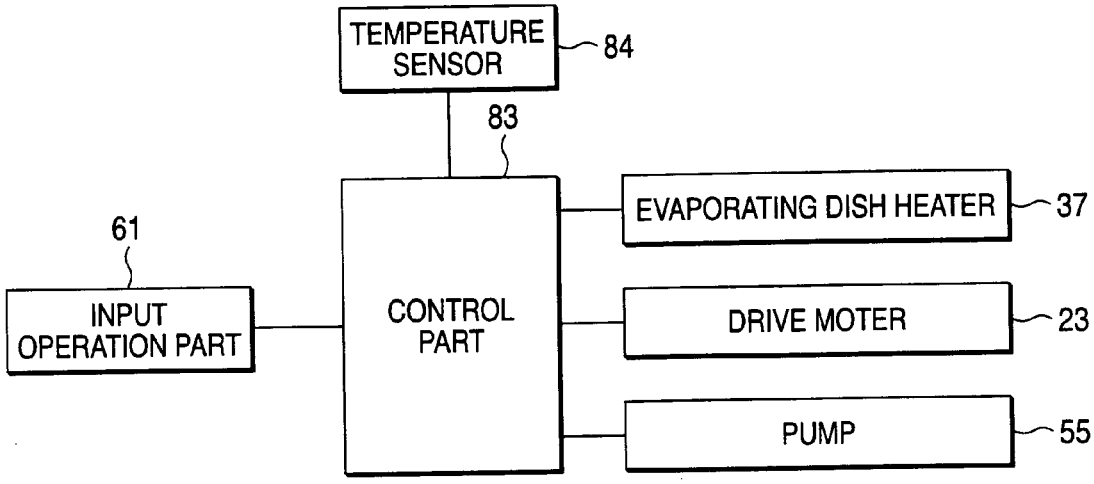
FIG. 8 is a control block diagram illustrating the high frequency heating apparatus.

FIG. 8 is a control block diagram illustrating a control system of the cleaning modes. The control system has a control part 83 to which input signals are inputted from the input operation part 61. To the control part 83, the evaporating dish heater 37, the drive motor 23 for rotating the circulation fan 17, and the pump 55 for supplying water to the evaporating dish are connected and controlled by the control part 83. In addition, a temperature sensor 84 such as a thermistor for detecting the temperature of the evaporating dish 35 is connected to the control part 83. Detection signals from the temperature sensor 84 are inputted to perform feedback control over the evaporating dish heater 37. Then, the control part 83 controls the evaporating dish heater 37, the drive motor 23 and the pump 55 in accordance with a predetermined sequence based on the input signals from the input operation part 61 and the detection signals from the temperature sensor 84.

The operation in steam heating will be described as one example of the basic heating operation according to the high frequency heating apparatus 100 having the configuration described above.

Figure 9:
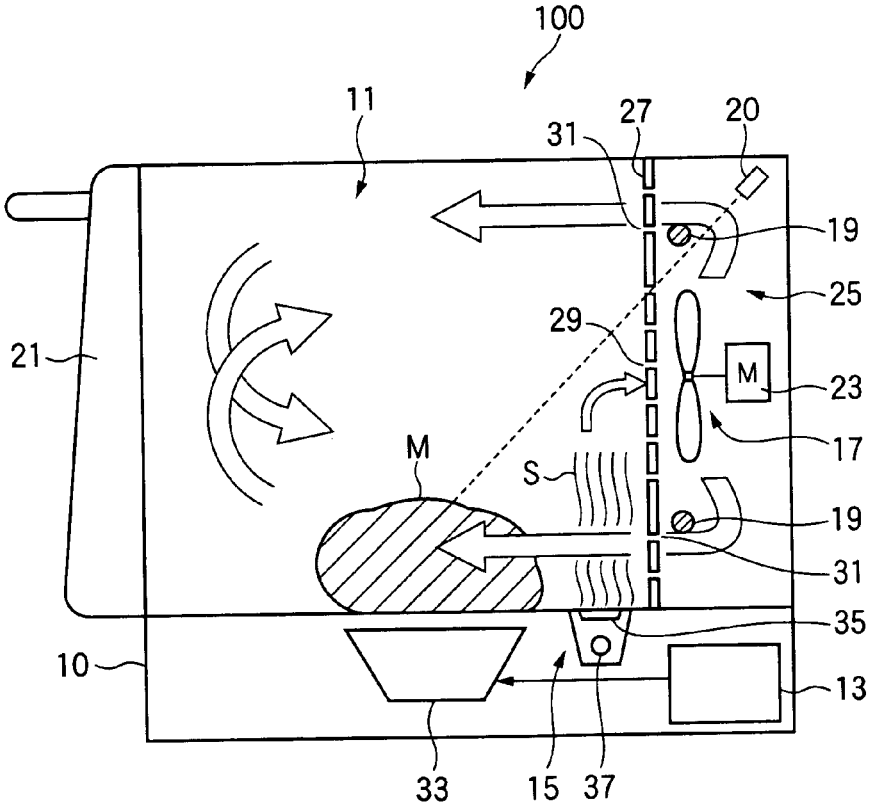
FIG. 9 is an explanatory diagram illustrating the operation of the high frequency heating apparatus.

When the steam heating mode is selected among the various heating modes such as the high frequency heating mode, the steam heating mode and the oven heating mode and the start switch 65 is pressed down, the evaporating dish heater 37 is turned on to heat water in the evaporating dish 35 supplied by the pump 55 from the water tank 43, and steam S is generated as shown in FIG. 9 that depicts an explanatory diagram illustrating the operation of the high frequency heating apparatus 100. The steam S rising from the evaporating dish 35 is aspirated into the center part of the circulation fan 17 from the air intake vent holes 29 disposed nearly in the center part of the partition plate 27, and is blown toward the inside of the heating chamber 11 from the air blowing vent holes 31 disposed around the periphery of the partition plate 27 through the circulation fan chamber 25.

The blown steam is stirred inside the heating chamber 11, and is again aspirated into the circulation fan chamber 25 side from the air intake vent holes 29 nearly in the center part of the partition plate 27. Thus, a circulation path is formed inside the heating chamber 11 and the circulation fan chamber 25. In addition, the generated steam is guided to the air intake vent holes 29 without arranging the air blowing vent holes 31 below the position of disposing the circulation fan 17 of the partition plate 27. Therefore, as depicted by outline arrows in the drawing, the steam circulates inside the heating chamber 11, and the steam is blown onto an object to be heated M efficiently.

At this time, since the steam inside the heating chamber 11 can be heated by the inside air heater 19, the temperature of the steam circulating inside the heating chamber 11 can be set at high temperature as well. Accordingly, so-called overheated steam can be obtained, also allowing cooking that the surface of the object to be heated M is browned.

Furthermore, when high frequency heating is performed, the magnetron 13 is turned on to rotate a stirrer 33, thereby supplying a high frequency into the heating chamber 11 as stirred. The high frequency heating apparatus 100 allows high frequency heat treatment with steam and high frequency combined.

The above is the procedures of the heat treatment including general steam heating. Next, the function of cleaning the inside of the heating chamber, which is the feature of the invention, will be described below.

Figure 10:
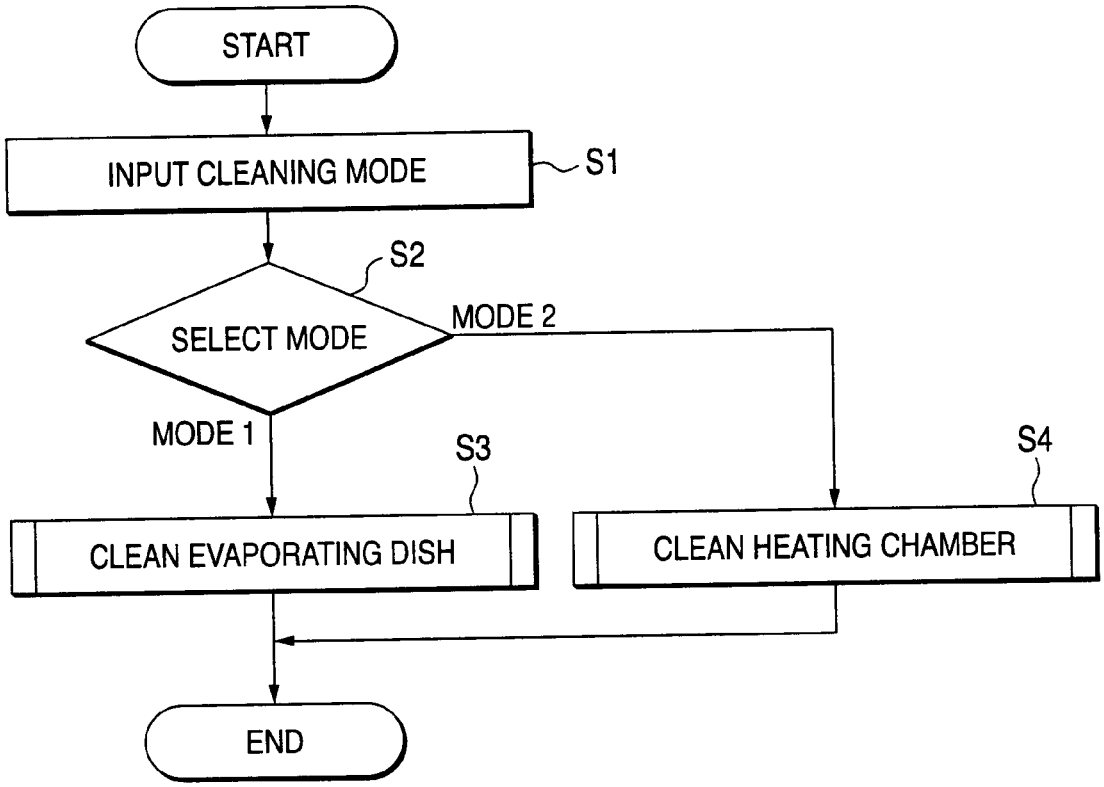
FIG. 10 is a flowchart illustrating a cleaning mode of the high frequency heating apparatus.

The operation of the high frequency heating apparatus 100 when the cleaning mode is selected and implemented by the input operation part 61 will be described by following a flowchart shown in FIG. 10.

When the cleaning switch 81 of the input operation part 61 is pressed down (Step 1; hereafter, it is called S1), an input signal is sent from the input operation part 61 to the control part 83 and the control part 83 is in a standby state for selecting the cleaning modes (S2). Subsequently, the setting dials 82 are turned in this state, thereby selecting the evaporating dish cleaning mode, heating chamber cleaning mode or deodorizing mode. When any one of the cleaning modes is selected to press down the start switch 65, the drive according to the selected cleaning mode is begun (S3 and S4).

Figure 11:
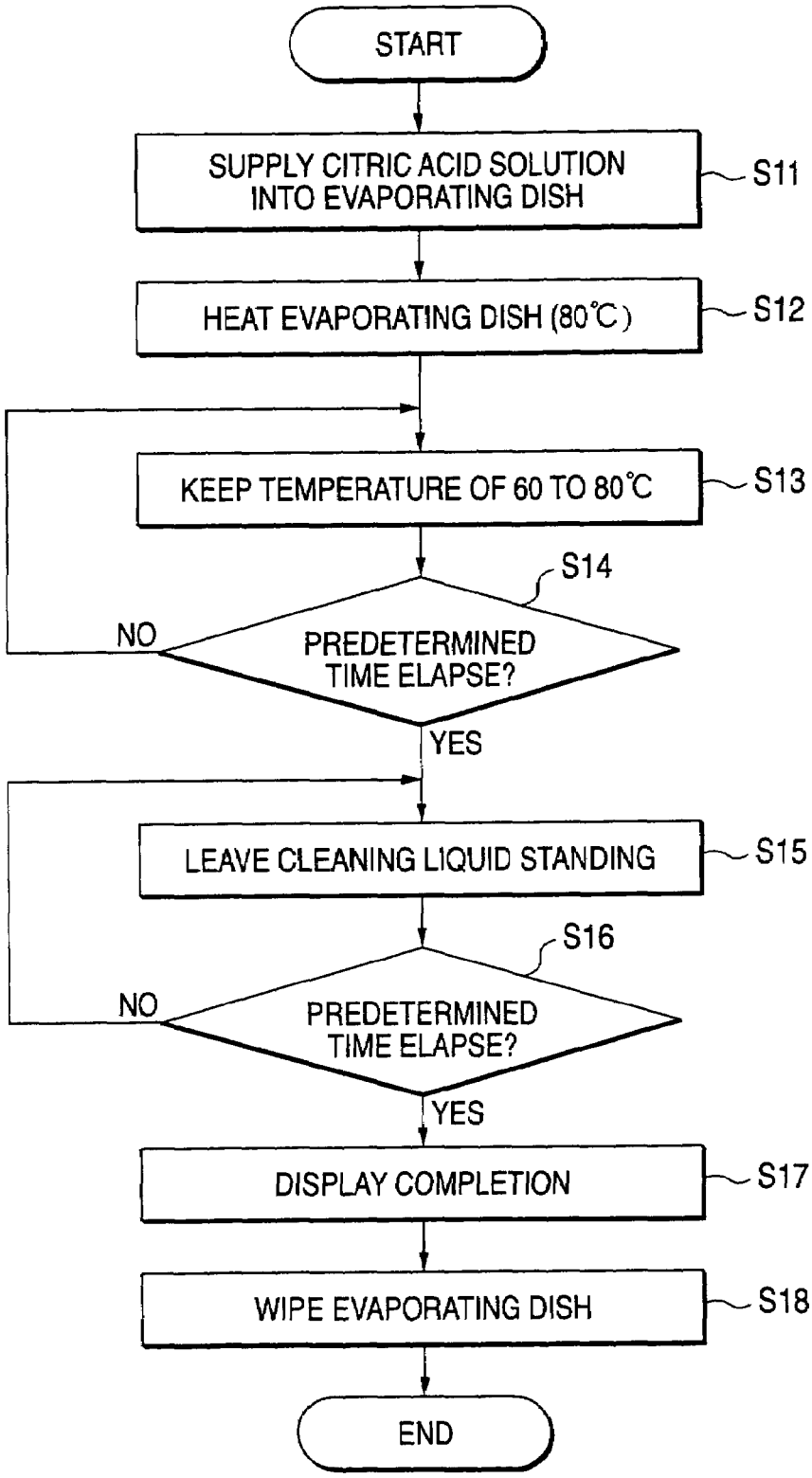
FIG. 11 is a flowchart illustrating an evaporating dish cleaning mode of the high frequency heating apparatus.
Figure 12:
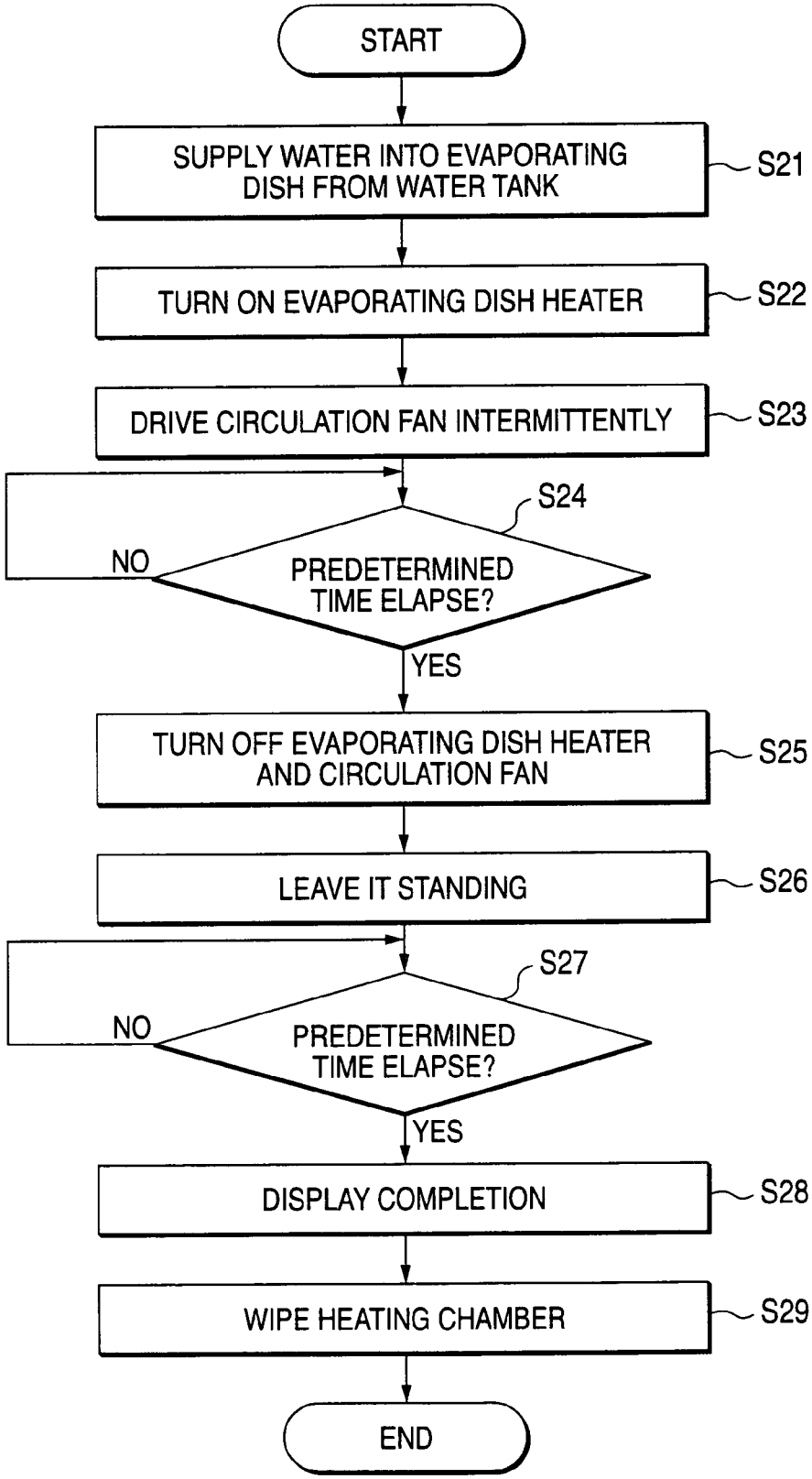
FIG. 12 is a flowchart illustrating a heating chamber cleaning mode of the high frequency heating apparatus.

Here, each of the cleaning modes will be described by following flowcharts shown in FIGS. 11 and 12.

(Evaporating Dish Cleaning Mode)

First, a cleaning liquid of citric acid dissolved in water is pumped into the evaporating dish 35 (S11). When the evaporating dish cleaning mode is selected and the start switch 65 is pressed down in this state, the evaporating dish 35 is heated by the evaporating dish heater 37 to heat the cleaning liquid inside the evaporating dish 35 at a temperature of about 80° C. in about one minute (S12). Then, the evaporating dish heater 37 is intermittently operated for five minutes so as to keep the temperature of the cleaning liquid at a temperature of about 60 to 80° C. (S13). Subsequently, the treatment to leave the cleaning liquid in the evaporating dish 35 is performed by gradually reducing the temperature to a temperature of about 40° C. to allow a wipe.

The time to leave the cleaning liquid therein elapses for a predetermined time (for about 30 minutes from the start of heating, for example) (S14), the message that cleaning is finished is displayed in the display panel 75 with a voice or warning sound for announcing the completion of cleaning (S15). When the completion of cleaning above is confirmed, the door 21 is opened to wipe the evaporating dish 35 with cloth (S16).

The evaporating dish cleaning mode is performed in this manner, the deposit such as calcium and magnesium deposited on the evaporating dish 35 is decomposed by citric acid, and it can be removed surely and easily.

Additionally, citric acid that is safe in food hygiene and highly effective for decomposing calcium and magnesium is preferably used as the cleaning liquid. However, not limited to this, it is acceptable that a surface active agent is added to the citric acid solution to enhance washability against oily soil, and it is fine to use other cleaning liquids.

(Heating Chamber Cleaning Mode)

When the heating chamber cleaning mode is selected and the start switch 65 is pressed down, water is intermittently supplied into the evaporating dish 35 from the water tank 43 by the pump 55 (S21). Subsequently, the evaporating dish heater 37 is turned on to heat the water in the evaporating dish 35, and steam is generated (S22). Then, the drive motor 23 of the circulation fan 17 is driven intermittently (S23). The drive of the drive motor 23 at this time is set to intermittent drive such as it is driven for two seconds in 30 seconds. Therefore, the circulating winds shown in FIG. 9 above can be obtained, the generated steam is spread in balance without remaining in the upper part of the inside of the heating chamber 11, and the steam is condensed over throughout the inner surface of the heating chamber 11.

Then, after a predetermined time of about 5 to 8 minutes elapse (S24), the pump 55 and the drive motor 23 are turned off (S25), being left in the condensed state (S26). When 30 minutes elapse from the start of the heating chamber cleaning mode (S27), the message that cleaning is finished is displayed in the display panel 75 with a voice or warning sound for announcing the completion of cleaning (S28) . When the completion of cleaning is confirmed, the door 21 is opened to wipe the inner surface of the heating chamber 11 with cloth (S29).

The heating chamber cleaning mode is performed in this manner, and the soil adhered to the inner surface of the heating chamber 11, such as the scatterings from the object to be heated M, floats from the inner surface of the heating chamber 11. The adhered soil is wiped with the degree of adhesion to the inner surface of the heating chamber dropped, thereby allowing the soil to be removed at once.

Furthermore, in the deodorizing mode provide along with the evaporating dish cleaning mode by steam and the heating chamber cleaning mode, the following operation will be performed.

When the deodorizing mode is selected and the start switch 65 is pressed down, the convection heater 19 and the drive motor 23 of the circulation fan 17 are driven separately. The inside of the heating chamber 11 is heated up to a temperature of about 230° C., the deposit such as oil scattered and adhered from the object to be heated M, which is the origin of odors, is burnt out on the inner surface of the heating chamber 11 applied with self-cleaning process.

In this manner, according to the high frequency heating apparatus 100 having the configuration above, the control part 83 implements the desired cleaning mode by controlling the steam generating part 15, the pump 55 for water supply, and the circulation fan 17 based on the signals inputted to the input operation part 61. Therefore, the inner surface of the heating chamber 11 and the evaporating dish 35 can be cleaned with a simple operation, and the inner surface of the heating chamber 11 and the evaporating dish 35 adhered with soil can be cleaned significantly easily to be in a clean state with no complex work.

More specifically, in the evaporating dish cleaning mode, the cleaning liquid made of citric acid solution is pumped into the evaporating dish 35, it is heated to a predetermined temperature, and it is left therein, thereby decomposing the soil such as calcium and magnesium deposited onto the evaporating dish 35. Accordingly, the deposit can be removed surely and easily only by wiping the evaporating dish 35. In addition, in the heating chamber cleaning mode, condensation is generated on the inner surface of the heating chamber 11 by steam, and the soil adhered to the inner surface of the heating chamber 11 is allowed to float to facilitate wiping the soil. Accordingly, the inner surface of the heating chamber 11 can be in a clean state.

Furthermore, in each of the cleaning modes, since cleaning is automatically performed by the high frequency heating apparatus 100 after the start switch 65 is pressed down, an operator does not need to monitor the high frequency heating apparatus 100 all the time, the operator is free from any constraint until the completion of cleaning is announced. Moreover, after cleaning is completed, the soil hard to be removed by general manners is in a state of removing it significantly easily. Thus, the soil can be removed sufficiently only by lightly wiping with no strength, and an excellent cleaning effect can be obtained easily.

Additionally, the high frequency heating apparatus in the invention is not limited to each of the embodiments described above, which can be modified and improved properly within the scope of the teachings of the invention not deviating it.

As described above, according to the high frequency heating apparatus in the invention, the specified cleaning mode is implemented based on the signal inputted to the control part through the signal input unit, thereby allowing the inside of the heating chamber adhered with soil to be cleaned significantly easily with no complex work.

What is claimed is:

1. A high frequency heating apparatus comprising:

a high frequency generating part for supplying a high frequency into a heating chamber for a food object to be heated;

a steam generating part for supplying steam into the heating chamber including:

an evaporating dish disposed inside the heating chamber for storing water and, an evaporating dish heating unit for heating the evaporating dish to generate steam; and, a control part having an evaporator dish cleaning mode to clean soil on the evaporator dish by pumping a cleaning liquid into the evaporator dish and heating it with the evaporating dish heating unit for a predetermined period of time.

2. The high frequency heating apparatus according to claim 1, further comprising a circulation fan for stirring air and the generated steam inside the heating chamber.

3. The high frequency heating apparatus according to claim 2, further comprising a water supply part for supplying water to the evaporating dish.

4. The high frequency heating apparatus according to claim 3, wherein the water supply part has a water tank, and a pump for supplying a predetermined amount of water into the evaporating dish from the water tank through a water pipe.

5. The high frequency heating apparatus of claim 1 further comprising:

a convection heater for heating the inside of the heating chamber;

wherein the control part further comprises a deodorizing mode to remove odors from the inside of the heating chamber by burning off food deposits from the inside of the heating chamber by heating the heating chamber to a predetermined temperature with the convection heater.

6. The high frequency heating apparatus of claim 5, wherein the control part further comprises a heating chamber cleaning mode to clean soil from the inside of the heating chamber by generating condensation on a surface of the heating chamber by automatically supplying steam into the heating chamber by the steam generating part.

7. The high frequency heating apparatus of claim 6 further comprising a signal input unit to implement any one of the cleaning modes.

8. The high frequency heating apparatus of claim 1, wherein the cleaning liquid is a citric acid.

9. A high frequency heating apparatus comprising:

a high frequency generating part for supplying a high frequency into a heating chamber for a food object to be heated;

a steam generating part for supplying steam into the heating chamber including:

an evaporating dish disposed inside the heating chamber for storing water and, an evaporating dish heating unit for heating the evaporating dish to generate steam;

a convection heater for heating the inside of the heating chamber;

a control part having multiple cleaning modes comprising:

an evaporator dish cleaning mode to clean soil on the evaporator dish by pumping a cleaning liquid into the evaporator dish and heating it with the evaporating dish heating unit for a predetermined period of time, a deodorizing mode to remove odors from the inside of the heating chamber by burning off food deposits from the inside of the heating chamber by heating the heating chamber to a predetermined temperature with the convection heater, and a heating chamber cleaning mode to clean soil from the inside of the heating chamber by generating condensation on a surface of the heating chamber by automatically supplying steam into the heating chamber by the steam generating part; and, a signal input unit to implement any one of the multiple cleaning modes.

10. The high frequency heating apparatus of claim 9, wherein the food object to be heated is heat treated by any one of the high frequency generating part and the steam generating part.

* * * * *